United States Patent [19]

Cassano et al.

[11] 3,977,780

[45] Aug. 31, 1976

[54] ELECTROSTATIC REPRODUCTION METHOD AND APPARATUS

[75] Inventors: James R. Cassano, Penfield; William A. Sullivan, Webster; Thomas M. Krissel, Rochester, all of N.Y.

[73] Assignee: Xerox Corporation, Stamford, Conn.

[22] Filed: Sept. 25, 1974

[21] Appl. No.: 508,924

[52] U.S. Cl. ..... 96/1 M; 355/3 R; 355/133; 96/1 R

[51] Int. Cl.[2] ..... G03G 13/00

[58] Field of Search ..... 355/17, 3 R, 11, 14, 355/16, 133

[56] References Cited

UNITED STATES PATENTS

| | | | |
|---|---|---|---|
| 3,615,128 | 10/1971 | Bhagat | 355/3 R |
| 3,661,453 | 5/1972 | McGuire et al. | 355/3 R |
| 3,756,488 | 9/1973 | Van Megen et al. | 355/16 UX |
| 3,795,442 | 3/1974 | Kimura et al. | 355/3 R |
| 3,865,480 | 2/1975 | Swanberg | 355/3 R |

*Primary Examiner*—R. L. Moses

[57] ABSTRACT

A copying system wherein a master of the document to be copied, such as a book, is electrostatically prepared on a copy substrate material in the form of a fanfolded web. The master bearing web is then used with an electrostatic type copier to produce the copies desired, the master bearing web being recycled the number of times required to produce the number of books desired. Each book may be segregated to permit subsequent binding where desired.

7 Claims, 5 Drawing Figures

ELECTROSTATIC REPRODUCTION METHOD AND APPARATUS

This invention relates to a reproduction system, and more particularly to improved reproduction system for producing pre-collated copy output.

Present day copying systems are often faced with a demand for copies in book form. One way to accomplish this is to couple the system reproduction machine or copier with a sorter, the latter serving to segregate the copies made in successive bins page by page. When copying of the last page is completed, the copies in each bin can then represent a complete book and the sorter can be emptied bin by bin and the contents bound together as by stapling to provide books.

However, the capacity of a sorter both in terms of total number of bins and number of pages that can be held by the individual bins is limited. It may, therefore, be desirable to avoid the use of a sorter, and in this situation another arrangement presents itself. Here, the originals are copied once, one page at a time, to provide one book copy, commonly termed a set, and this process is repeated for the second set, and so forth, and so on until the number of copy sets desired is made. In this arrangement, the copies may be collected in the same output tray, rather than in different bins of a sorter, and a relatively simple offsetting device provided to displace each book set slightly from the next for recognition purposes.

Unfortunately, the effectiveness of this latter system may be compromised due to the excessive handling of the originals that is required, since each original must be repeatedly brought into copying position the number of times equal to the number of sets desired. This, particularly in the case of a book original having a large number of pages and/or where a great number of copy sets is desired, could be untenable, particularly where the originals must be manually handled. As a result, automatic handling of the originals is generally considered necessary, but automatic document handlers having the speed, reliability, and ability to avoid damaging the originals have been difficult to achieve.

It is therefore a principle object of the present invention to provide a new and improved document reproduction system.

It is a further object of the present invention to provide a document reproduction system and method for automatically producing document sets from a pre-collated document input.

It is an object of the present invention to provide a reproduction system utilizing master intermediates.

It is an object of the present invention to provide method and apparatus for producing copies in book form without using a sorter in which the original pages of the book are first produced electrostatically on a web, and the web bearing the masters so produced recirculated in an electrostatic type copier the number of times required to produce the book sets desired.

It is an object of the present invention to provide a document reproduction system in which an intermediate master capable of being edited is used to produce book copies.

It is an object of the present invention to provide an improved book making method and apparatus.

The invention relates to a method of copying a set of original documents to produce a predetermined number of copy sets, the steps consisting of: producing a permanent master copy of each document comprising the set in succession on an endless web; bringing the web into operative relationship with copying apparatus to produce copies; operating the copying apparatus while advancing the web to make one copy of each master in sequence; and recirculating the web the number of times equal to the predetermined number of sets desired.

The invention further relates to an apparatus for producing copies in sets comprising, in combination, first electrostatic means to produce a master of each original comprising the set on a web, the first electrostatic means including fusing means to render the masters produced on the web permanent, and second electrostatic means for producing copies from the masters, the second electrostatic means including transport means to recirculate the web once for each of the copy sets desired.

Other objects and advantages of the present invention will be apparent from the ensuing description and drawings in which.

Figure 1:
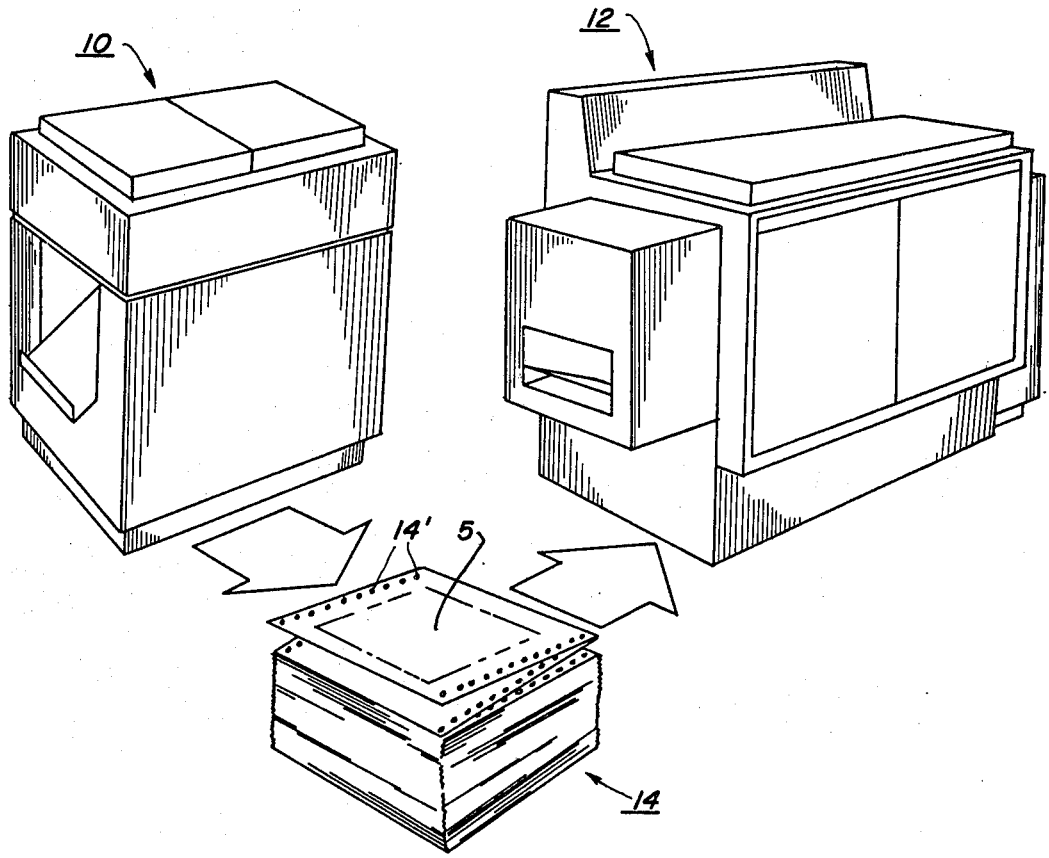
FIG. 1 is an isometric view showing the improved reproduction system of the present invention.

Referring particularly to FIG. 1 of the drawings, there is shown an exemplary master maker, designated generally by the numeral 10, and a reproduction machine or copier, designated generally by the numeral 12 for carrying out the present invention. While master maker 10 and copier 12 are illustrated as being off-line, an on-line arrangement wherein the master copies produced by master maker 10 are fed directly to copier 12 may be envisioned.

Figure 2:
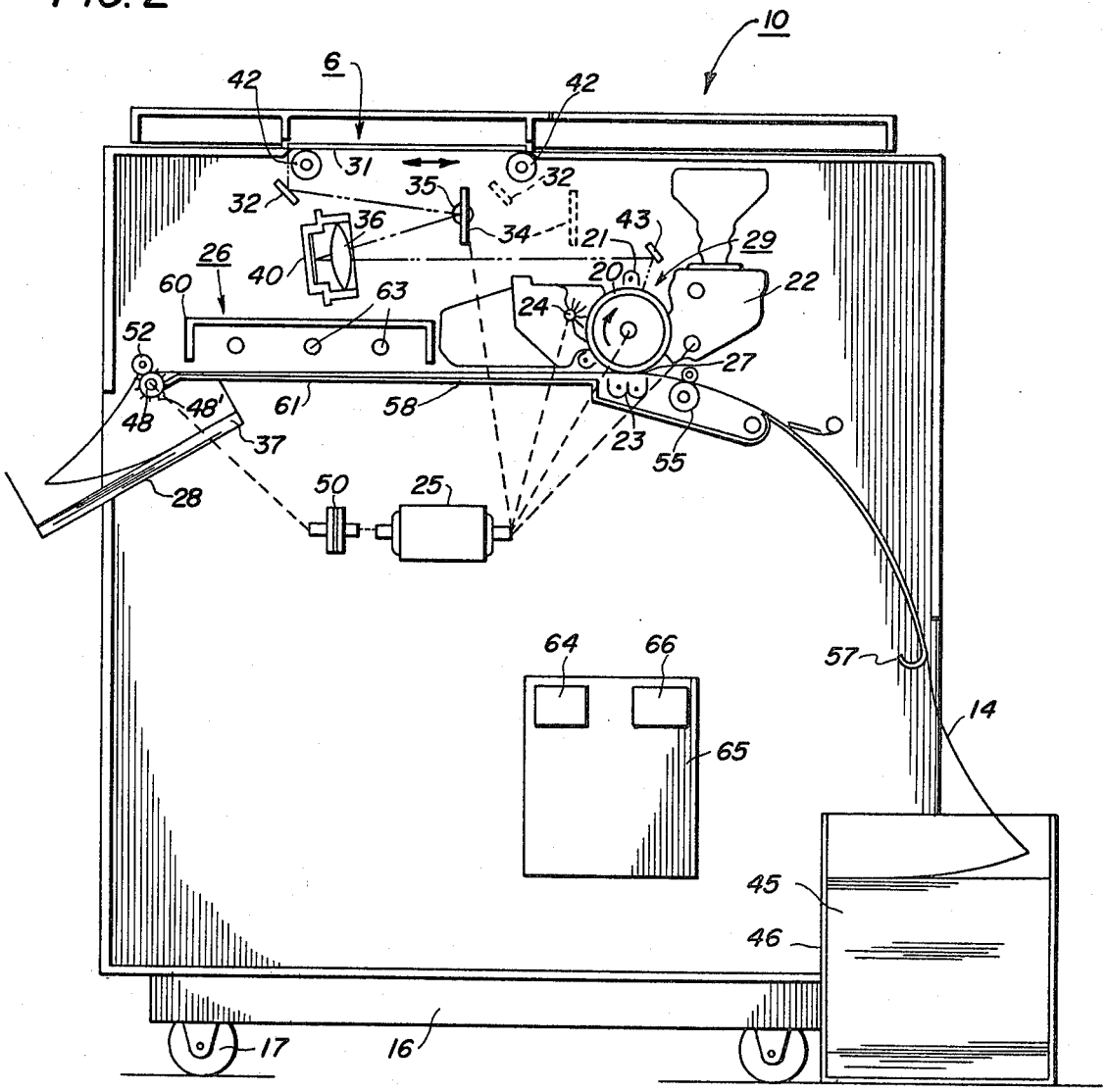
FIG. 2 is a schematic view of an exemplary master maker adapted for use in carrying out the present invention.

Referring now to FIG. 2, master maker 10 includes a suitable frame 16 conveniently supported on castors 17 to enhance mobility of the master maker. Master maker 10 is a electrostatic type reproduction apparatus adapted to electrostatically produce on web 14 masters 5 of the original 6 being copied. For this purpose, there is provided on frame 16 a rotatable xerographic drum 20, having disposed thereabout and in operative relationship thereto a corona charging device 21, xerographic developer 22, a transfer corona device 23, and drum cleaning brush 24. A drive motor 25 is provided, motor 25 being driveably coupled to drum 20 to rotate drum 20 in the direction shown by the solid line arrow. As will appear, the masters 5 are formed on a web 14, which is preferably a fanfolded material of the type used with computers. Web 14 operatively contacts xerographic drum 20 at transfer station 27 opposite the transfer corona device 23 whereat the electrostatic image developed on drum 20 is transferred thereto. Thereafter as will appear, web 14 passes through fuser 26 wherein the toner images thereon are permanently fixed. The image bearing web 14 is received in output tray 28 in the form of a flat pack 37.

Drum 20, which is cleaned by brush 24 following use, is charged by the corona charging device 21 in preparation for exposure at exposure station 29. The image at exposure station 29 is provided by scanning the original 6 resting on transparent platen 31, and for this purpose a scanning mirror couple 32, 34 and exposure lamp set 42 are provided. Mirrors 32, 34 are supported upon a moveable carriage 35 adapted to reciprocate back and forth as shown by the arrows in FIG. 2, carriage 35 being driven by motor 25 via a suitable transmission (not shown). The image reflected by mirrors 32, 34 passes through a lens array 36 which focuses the image onto a transfer mirror 40. From mirror 40 the image is reflected to image mirror 43 and from mirror 43 onto drum 20 at exposure station 29. Exposure lamps 42 which are disposed beneath platen 31 illuminate the original resting thereon.

A supply 45 of web material is provided in tray 46. A toothed feed wheel 48 is provided adjacent the inlet to output tray 28, teeth 48' on wheel 48 cooperating with perforations 14' (see FIG. 3) in the side margins of web 14, to draw web 14 from the supply tray 46 through transfer station 27 and fuser 26 with discharge into tray 28. A suitable clutch mechanism 50 drivingly couples feed roll 48 with motor 25.

To retain the margin perforations of web 14 in driving engagement with feed roll 48, a cooperating idler roll 52 is provided. Pinch roll pair 55 serve to guide web 14 to operative relation with drum 20 at transfer station 27. Suitable web guides, 57, 58 are also provided to facilitate routing of web 14 through the master maker 10.

Fuser 26 includes a cooperating upper reflector housing 60 and lower base 61 between which web 14 passes. One or more heating lamps 63 within upper housing 60 serve as a source of heat, the heat output of lamps 63 and the design of fuser 26 being such that stopping of web 14 therewithin for relatively long periods, as for example, during the copying cycle, will not result in charing or burning of the web 14.

A suitable controller 65 is provided for operating the various components of master maker 10 in a predetermined cycle to make copies as will be understood by those skilled in the art.

To prepare masters on web 14, the web from supply tray 14 is threaded over guide 57 and between pinch roll pair 55 to transfer station 27. There the web is passed between drum 20 and transfer corona device 23, and along guide 58 to fuser 26. The web is passed through the fuser upper and lower sections 60, 61 and is threaded onto feed roll 48 with perforations 14' in the web margins engaged with teeth 48' of roll 48.

An original 6, which may comprise one page of a book, is placed face down on platen 31. The master maker 10 is actuated as by depressing a suitable start button 64. Controller 65 responds to actuate motor 25 and clutch 50 to initiate scanning movement of carriage 35, rotation of drum 20 and rotation of feed wheel 48, the latter drawing web 14 forward from tray 46 at substantially the same speed as drum 20. Exposure lamps 42, corona charging device 21, transfer device 23, and fuser lamps 63 are activated and developer 22 and cleaning brush 24 which are driven from motor 25 via suitable clutch devices (not shown) are also started. It will be understood that the aforedescribed startup of master maker 10 takes place in a predetermined timed cycle with provision being made for the operation characteristics of various components i.e. the time period required for fuser 26 to reach operating temperatures.

The electrostatic latent image produced upon exposure of drum 20 to the document on platen 31 is developed by developer 22 and transferred at exposure station 27 to web 14. Continued movement of web 14 brings the transferred image to fuser 26 whereat the image is permanently fixed. Thereafter, the image bearing web portion is deposited in output tray 28.

Following transfer, leftover developer is removed from drum 20 by brush 24, the drum being again charged by corona device 21 for reuse.

Controller 65 includes a suitable timing device effective to stop drum 20 and movement of web 14 upon completion of the scanning cycle and return of carriage 35 to the start of scan position. At this point, the original 6 on platen 31 is removed and the next one. i.e. page 2 of the book being copied, substituted.

Following exposure of the last original to be copied, i.e. the last page of the book and transfer of the image therefrom onto web 14, suitable control means i.e. jog button 66 is provided to sustain operation of motor 25 and rotation of drum 20 and movement of web 14 until the last image is processed through fuser 26 and deposited in tray 28.

Figure 3:
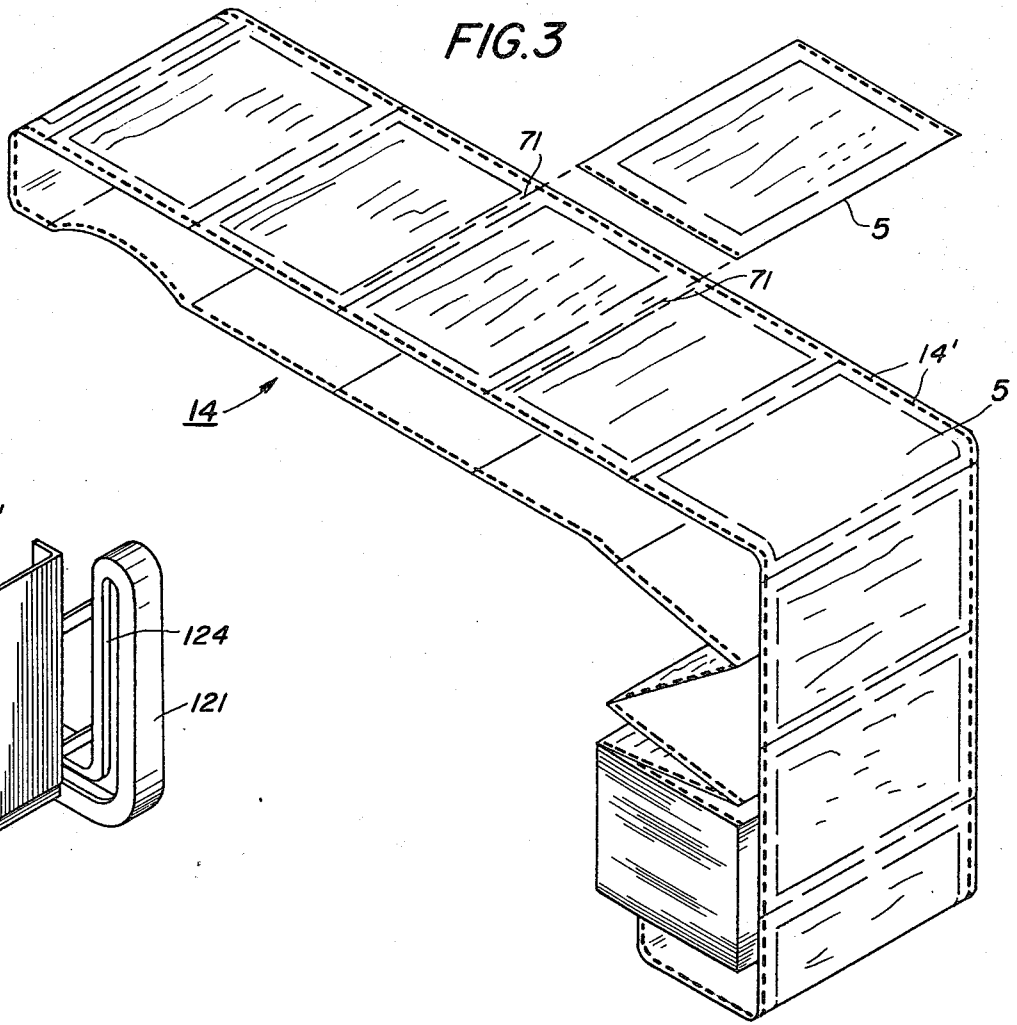
FIG. 3 is an enlarged isometric view showing editing of the copy master.

Referring now to FIG. 3, the completed master, bearing web 14, which for example, may comprise the pages of a book, may now be used with copier 12 to produce copies as will appear. Web 14 may, at this time, be conveniently edited to remove, add, and/or substitute masters. For example, if the quality of a master 5 is unacceptable, a new master may be prepared. Substitution of the new master 5 may be effected by cutting the unacceptable master out and inserting the new master in place thereof. The new master may be affixed in position within the web 14 by means of flexible adhesive tape 71. In a similar manner existing masters can be removed or new masters added to the completed web 14.

Figure 4:
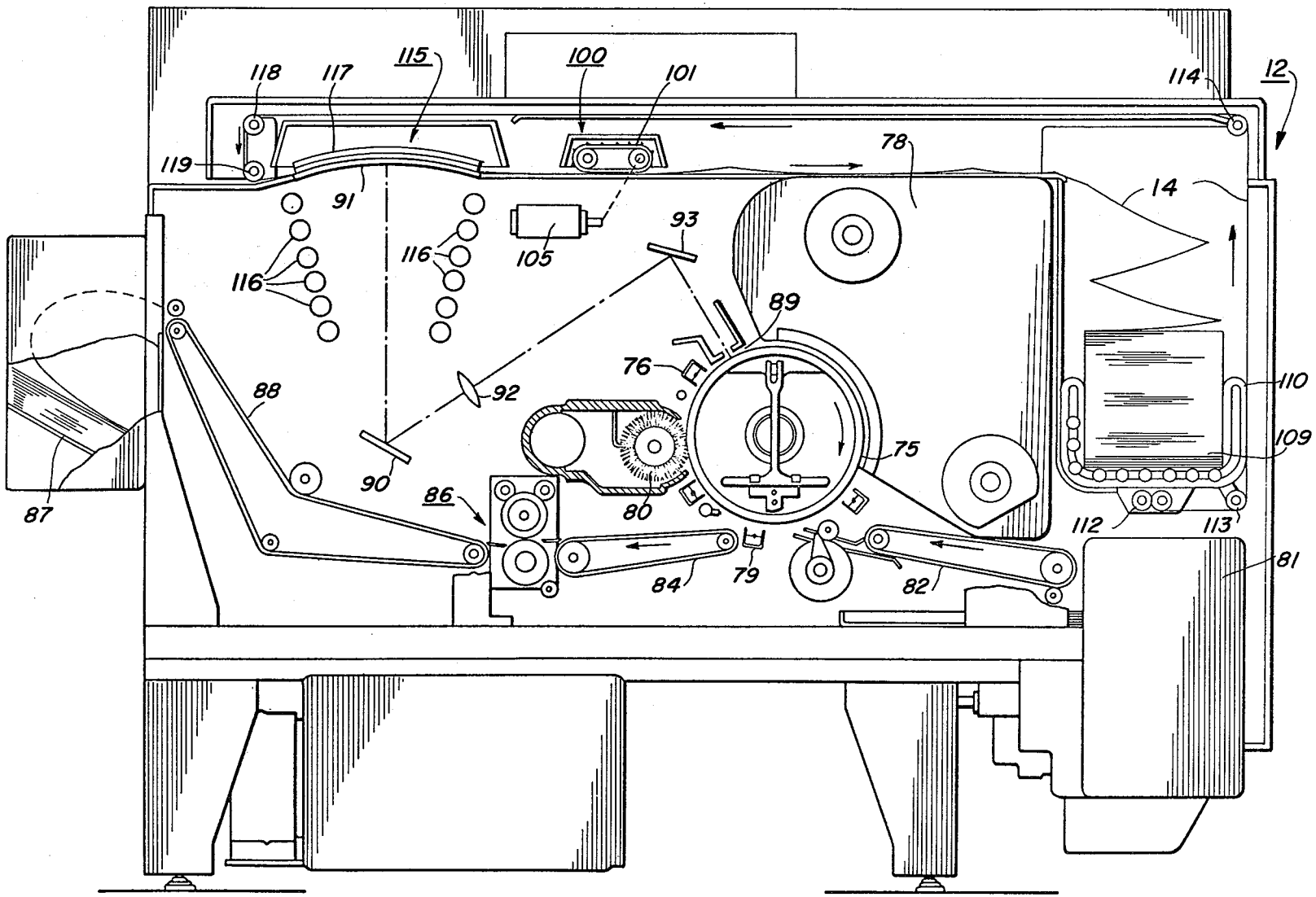
FIG. 4 is a schematic view of an exemplary copier adapted for use in carrying out the present invention.

Referring now to FIG. 4, of the drawings, there is shown an exemplary copier 12 of a type suitable for use with the present invention. Copier 12 has a rotating xerographic drum 75, a corona charging device 76, a xerographic developer 78, a transfer corotron 79 and a drum cleaning brush 80. Copy paper in the form of cut sheets stored in supply tray 81 are fed out one by one by a suitable paper feeder (not shown) onto conveyor 82. Conveyor 82 brings the individual sheets into operative transfer relationship with drum 75 opposite corotron 79 whereat transfer of the image developed on drum 75 to the individual copy sheets takes place. Conveyor 84 carries the image bearing sheets to a roll type fuser 86 where the toner delineated image is permanently fixed. The fused copy is discharged into output tray 87 by conveyor 88.

The xerographic drum 75, following cleaning by brush 80, is charged by the corona charging device 76 prior to exposure to the image being copied at exposure station 89. The image at station 89 originates from scanning by rotating mirror 90 the document resting on platen glass 91, the image reflected by mirror 90 passing through lens 92 and mirror 93 onto the surface of drum 75 at exposure station 89.

Copier 12 is adapted to copy either individual documents or continuous documents as from the master bearing web 14 produced on master maker 10 as described earlier. For web 14, copier 12 includes, adjacent one side of transparent platen 91, a form or web feeder 100 having a pair of endless sprocketed feed tractors 101 cooperable with edge perforations 14' in web 14 to draw the fanfold material across platen 91. Feed tractors 101 are intermittently driven by motor 105 to draw or index the web 14 in increments corresponding to one master 5, copying thereof being effected while drive to feeder sprockets 101 is interrupted and web 14 is stationary.

As seen in FIG. 4, platen 91 of copier 12 is arcuate, the individual document or the portion of fanfolded web 14 then being copied resting thereupon during the copying cycle. Other platen shapes, i.e. flat, may be readily envisioned.

Web 14 is stored in flat pack 109 form in supply tray 110 appended to one side of copier 12. As will appear more fully hereinafter, web 14 is fed from the bottom of supply pack 109 via pinch roll pair 112 and guide rolls 113, 114, 118, and 119 into juxtaposition with platen 91. Rolls 112, 113, 114, 118 and 119 are rotatably supported on the frame of copier 12 by suitable means (not shown).

As seen best in FIG. 4 of the drawings, a platen cover 115 is provided atop platen 91. Cover 115 is hingedly attached to the frame portion (not shown) of copier 12 for raising or lowering movement off of or onto platen 91. Cover 115 serves to protect platen 91 against damage when copier 12 is not in use and, during the copying cycle, to protect the user's eyes against extraneous light emitted by exposure lamps 116. The hinged attachment of cover 115 allows platen 91 to be readily accessed as when loading or unloading individual documents or when locating and threading web 14 into place on copier 12.

Platen cover 115 includes an internal cover part 117 spaced slightly above platen 91 when cover 115 is closed, and cooperably therewith to form a passage between which web 14 passes during the copying cycle. In this manner, cover 115 functions to hold the web in operative juxtaposition with platen 91 as the web passes thereover.

Figure 5:
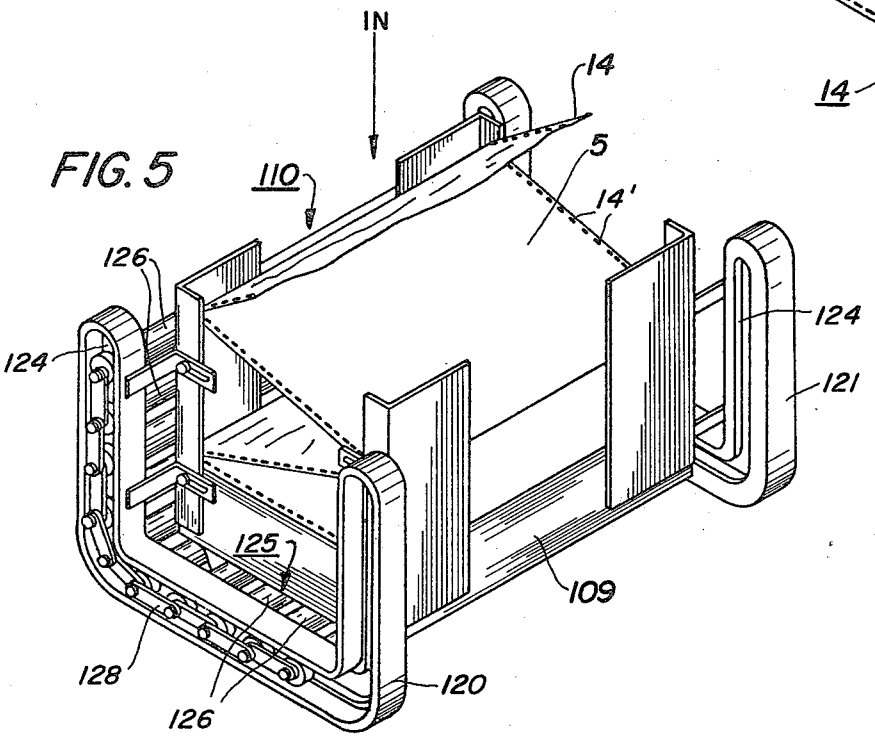
FIG. 5 is an enlarged isometric view showing details of the master supply and dispencing tray.

Referring now to FIG. 5, pack supply tray 110, is comprised of a pair of side members 120, 121 each constructed to form a generally U-shaped track 124 through which a series of rollers 126 making up base 125 of tray 110, extend. Rollers 126 rest within and are supported by side members 120, 121, the dimension of tracks 124 being slightly larger than the diameter of rollers 126. By this construction, rollers 126 are free to turn and base 125 to move back and forth within the confines of tracks 124.

The number of rollers 126 utilized is sufficient to support the pack of fanfolded web 14, and in the exemplary embodiment shown, eight rollers 126 are provided with web 14 being fed between the innermost roller pair. To maintain tray base forming rollers 126 in spaced relationship relative to one another, spacer links 128 are pivotally secured between adjoining rollers at each end thereof.

In operation, as web 14 is withdrawn from the bottom of pack 109, base 125 oscillates back and forth within tracks 124 in accordance with the point of unfolding of web 14 from pack 109. This displacement in the point of unfolding reduces the force required to unfold web 14 and prevents tearing or ripping thereof.

To reproduce masters on web 14, the master bearing web, in the form of a flat pack 109 and with leading and trailing web ends free, is set into supply tray 110. In doing so, the web leading end may be inserted between the innermost rollers of base 125, and from there routed between roll pair 112 and over guide rollers 113, 114, 118, 119 to platen 91. There, the leading end is led across platen 91, cover 115 being raised for this purpose. Since the leading end is normally the first page of the book to be reproduced, the first master 5 on web 14 is in proper location on platen 91 to initiate copying. The trailing end of web 14 is drawn off of the top of pack 109 and threaded onto tractors 101. Following this, the leading and trailing ends of web 14 are abutted and joined together by adhesive tape 71 to form an endless loop. On closing of cover 115, copier 12 is ready for operation, presuming the various operating components thereof, i.e. fuser 86 are in a state of readiness.

With web 14 loaded, the operator selects the number of copy sets desired and activates the copier 12 as by means of a suitable print/start button (not shown). Copier 12 thereafter proceeds to copy each master once, feeder tractors 101 being actuated following each copy to index web 14 to bring the next master into position on platen 91. As copies of web 14 are made, fresh web material is unfolded from the bottom of pack 109 and routed over guide rolls 112, 113, 114, 118 and 119 to platen 91. At the same time, the used web is restacked onto pack 109. The above proceeds until the last master on web 14 has been copied, at which point copier 12 is stopped or the above procedure repeated to form another set of copies in accordance with the program under which copier 12 is operated.

Instead of moving web 14 incrementally in page by page fashion, tractors 101 may be operated continuously in synchronism with drum 75 of copier 12 to produce copies.

It will be understood that suitable self threading means (not shown) may be provided to automatically thread the leading end of the web 14 from supply tray 110 into operative relationship with platen 91 of copier 12, and from there back to tray 110. In this circumstance, web 14 may be provided with a suitable leader (not shown) to facilitate automatic threading.

While the invention has been described with reference to the structure disclosed, it is not confined to the details set forth, but is intended to cover such modifications or changes as may come within the scope of the following claims.

What is claimed is:

1. The method of copying a set of original documents to produce a predetermined number of copy sets, the steps which comprise:

a. producing on a master maker a permanent master copy of each document comprising said set in succession on an endless web;

b. bringing the web into operative relationship with copying apparatus to produce copies from the master copies on said web;

c. actuating said copying apparatus while advancing said web to make one copy of each master in sequence; and d. recirculating said web the number of times equal to the predetermined number of sets desired.

2. The method according to claim 1, including the step of coupling the ends of the web together to form an endless loop of said master copies.

3. The method according to claim 1, including the step of electrostatically producing both said master copies and said copy sets.

4. The method according to claim 1, including the step of producing said master copies on fanfolded web.

5. The method according to claim 4, including the step of editing said web by replacing undesirable master copies with other master copies while producing said web.

6. In an apparatus for producing copies in sets, the combination of a. first electrostatic means for producing a master of each of a plurality of originals comprising said set on a fanfolded web, said first electrostatic means including fusing means to render the masters produced on said web permanent; and b. second electrostatic means for producing copies from said masters, said second electrostatic means including web transport means for recirculating said web once for each of said copy sets desired.

7. The apparatus according to claim 6, including means to flexibly couple the ends of said web together to form an endless loop.

* * * * *